United States Patent [19]

Kuervers

[11] Patent Number: 4,938,477

[45] Date of Patent: Jul. 3, 1990

[54] WRIST ENGAGING EXERCISE DEVICE

[76] Inventor: Douglas T. Kuervers, 5204A Bowness Road, N.W., Calgary, Alberta, Canada, T3B 0C3

[21] Appl. No.: 336,767

[22] Filed: Apr. 12, 1989

[51] Int. Cl.[5] ..... A63B 21/065

[52] U.S. Cl. ..... 272/119; 272/67; 272/128; 63/3

[58] Field of Search ..... 272/67, 68, 93, 122, 272/123, 124, 117, 128, 143, 119; 446/170; 63/2, 3, 5.1, 6, 31, DIG. 3

[56] References Cited

U.S. PATENT DOCUMENTS

| | | | |
|---|---|---|---|
| 1,604,333 | 10/1926 | Anderson . | |
| 2,475,656 | 7/1949 | Bidak . | |
| 2,819,081 | 1/1958 | Touraine . | |
| 3,019,019 | 1/1962 | Forte . | |
| 3,294,399 | 12/1966 | Cugliari . | |
| 4,036,491 | 7/1977 | Vierra et al. | 272/119 |
| 4,356,915 | 11/1982 | Phillips | 446/170 X |
| 4,480,831 | 11/1984 | Müller-Deinhardt | 272/128 |
| 4,489,935 | 12/1984 | Lusk . | |
| 4,632,391 | 12/1986 | Orak | 272/128 |
| 4,768,688 | 9/1988 | Harrigan | 63/3 X |

FOREIGN PATENT DOCUMENTS

| | | | |
|---|---|---|---|
| 1208935 | 2/1960 | France | 272/128 |
| 633530 | 11/1978 | U.S.S.R. | 272/67 |

*Primary Examiner*—Robert W. Bahr

*Attorney, Agent, or Firm*—Irell & Manella

[57] ABSTRACT

A hollow ring is formed in two parts hinged together at one end of each half and detachably secured together at the other ends of each half by a clasp to form a torus. A pair of spaced apart pads are situated on the inner surface of one portion and a diametrically adjustable pad is situated centrally of the other half and also on the inner surface. The ring engages around the wrist of the user with pads holding the ring in position yet preventing pressure from occurring on the wrist veins and arteries. One or more balls of steel or other material may be placed in each torus and roll around the rings while exercising by rotating the arms and the like. The degree of effective weight is controlled by the number and weight of the balls.

20 Claims, 3 Drawing Sheets

WRIST ENGAGING EXERCISE DEVICE

This invention relates to new and useful improvements in wrist exercising devices which may be detachably secured around the wrists and rotated thereby thus permitting the exercising of the wrists, forearms, full arms, shoulders and upper part of the body.

Many attempts have been made to provide a relatively simple exercising device for the above purposes and prior art known to the applicant include the following:

U.S. Pat. No. 1,604,333, Oct. 26, 1926, J.R. Anderson.

This is a wrist exerciser secured to the wall and having a hand grip secured to the support for rotation thereon with adjustable resistance being provided.

U.S. Pat. No. 2,475,656, July 12, 1940, J. Bidak.

This shows an exerciser consisting of a rod with a reel intermediate the ends thereof having a cable therearound from which weights may be suspended so that rotation of the rod by the wrists in order to wind up the weights, applies resistance to the rotation of the hands relative to the forearms.

U.S. Pat. No. 2,819,081, Jan. 7, 1958, J. Touraine.

This shows a fixed ring on a wheel supported board with an inner wheel having a diametrically situated spoke which is grasped by the hand of the user and rotated against resistance or which may be locked in place so that a static exerciser is provided.

U.S. Pat. No. 3,019,019, Jan. 30, 1962, F.C. Forte.

This shows a pulley and weight system in which the weights are lifted by a substantially horizontal movement of the other end of the cable by the user.

U.S. Pat. No. 3,294,399, Dec. 27, 1966, S. Cugliare.

This is a manually operated weight resistant exercising device once again utilizing a cable and pulley with weights on the lower end of the cable and the horizontal portion being moved by the user in order to lift the weights.

U.S. Pat. No. 4,489,935, Dec. 25, 1984, J.D. Lusk.

This consists of a cuff-like shackle component to fit over the forearm with an attached hand grip member. A holding pedestal for weights with a plurality of weights which may be fitted on the holding pedestal and a flexible connecting member to connect the cuff-like shackle component to the holding pedestal.

Prior art exercising devices have been limited to general exercises with or without use of apparatus and equipment such as dumbbells, weighted pulleys, chinning bars and the like and although some of these devices were specifically designed to develop the arm muscles, nevertheless full exercising capabilities were not available by the use of such apparatus except where very expensive and permanently installed equipment was utilized.

The present invention overcomes these disadvantages by relatively simple construction which is easily carried by the user and can be used wherever desired.

One aspect of the invention consists of a wrist engaging exercising device comprising in combination a hollow member, means for detachably engaging same around the wrist of a user, means to adjust the effective diameter of the device to fit, within limits, wrists of various thicknesses, and at least one weight confined within said hollow member but freely movable therearound.

Another aspect of the invention consists of a hollow cylindrical member in the form of a torus which can be strapped to the wrist and can have one or more weighted balls rotating around the track formed by the outer shell of the torus with the weight being controlled by the number of balls and the weight thereof.

This permits the user to secure the device to the wrist and by rotating the wrist or swinging the arms, a full range of exercises may be undertaken to strengthen wrists, arms, shoulders and the upper part of the body.

By using various arm positions, the work effort can be concentrated on different muscle groups and a simple circular movement of the wrists starts the balls rotating.

The device can be used to provide an excellent aerobic exercise as well as firming the muscles and burning off fat.

Another advantage of the invention is to provide a device which is simple in construction, economical in manufacture and otherwise well suited to the purpose in which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 4:
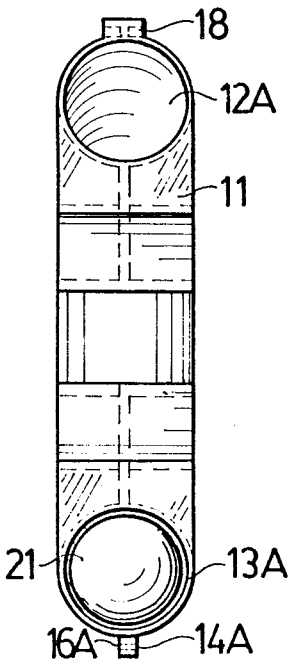
FIG. 4 is an inside view at right angles of FIG. 3.
Figure 3:
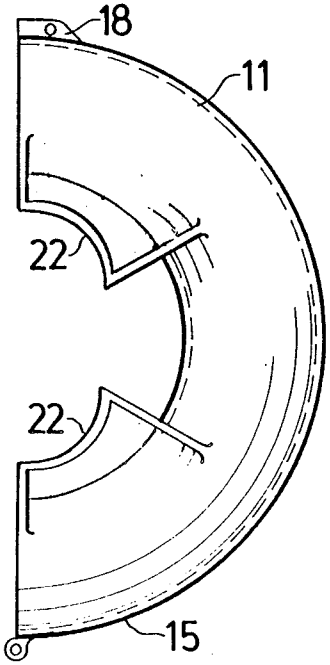
FIG. 3 is a front elevation of the other half of the device.

Proceeding therefore to describe the invention in detail, the device consists of two semi-cylindrical halves 10 and 11 formed from a hollow circular cross-section, plastic and being open-ended as indicated by reference characters 12 and 13 insofar as the half 10 is concerned and 12A and 13A insofar as the half 11 is concerned.

When assembled together as will hereinafter be described, a hollow torus is formed which is circular in cross-section or configuration as clearly shown.

Figure 2:
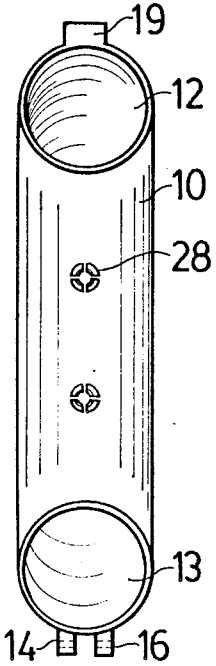
FIG. 2 is an inside view taken at right angles to FIG. 1.
Figure 1:
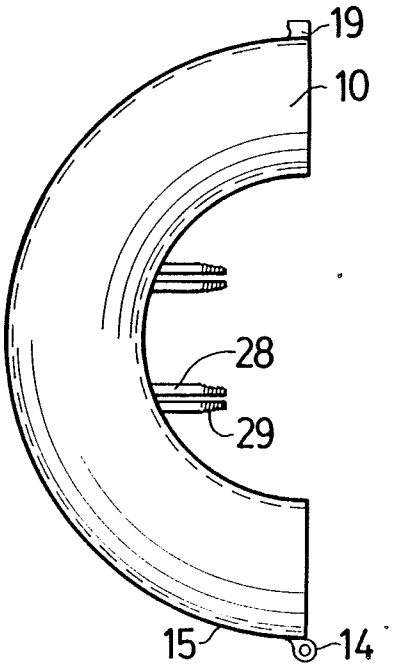
FIG. 1 is a side elevation of one half of the device with the adjustable pad removed.

Means are provided to detachably secure the halves together and take the form of lugs 14 and 14A situated on the outer surface 15 of the halves. The lugs 14 consist of a pair of spaced apart lugs shown in FIG. 2 having a transverse aperture 16 formed therethrough.

14A shows a single lug with a transverse aperture 16A formed therethrough and which engages between lugs 16 when assembling the device whereupon a pin (not illustrated) may extend through apertures 16 and 16A in order to hingedly secure the two halves together for an opening and closing movement.

Figure 5:
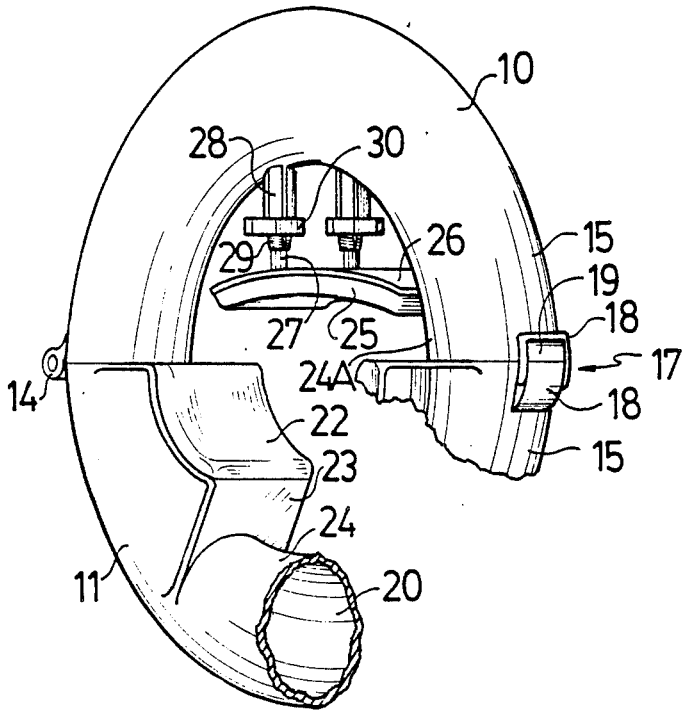
FIG. 5 is an isometric view of the assembled device cut away in part to show the interior thereof.
Figure 6:
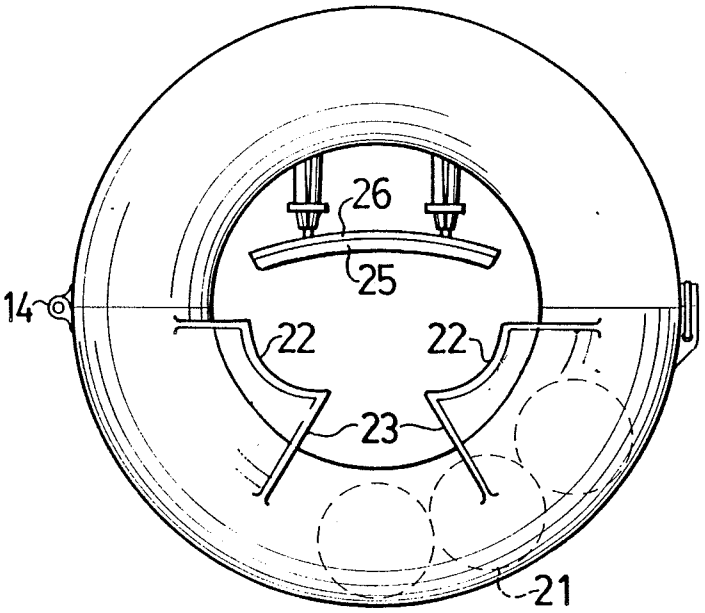
FIG. 6 is a front elevation of FIG. 5.
Figure 7:
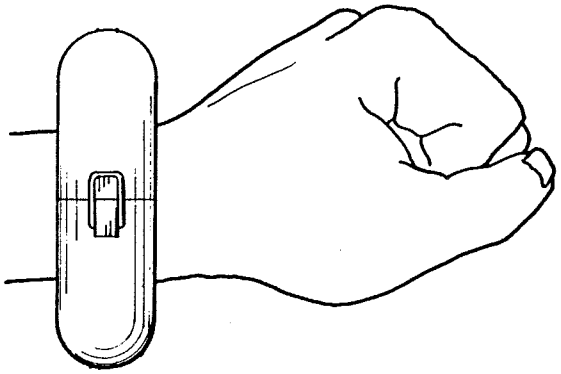
FIG. 7 is a partially schematic view of the device situated upon the wrist of a user.

When in the closed position shown in FIGS. 5 through 7, a clasp collectively designated 17 holds the two halves together by the other adjacent ends thereof as clearly shown in FIG. 5. The halves consist of a loop 18 pivotally supported within a portion 18 extending from the outer surface 15 of the wall of portion 11 which is detachably engagable over a clip portion 19 extending from the outer surface 15 of the portion or half 10 as clearly shown in FIG. 5.

This secures the two halves together in the form of the torus and provides an endless hollow track 20 defined by the walls of the two halves.

One or more balls 21 may be deposited within the track before closing the two halves together and these balls may be made of steel or other weighted material. The diameter of the balls is slightly less than the diameter of the track 20 so that when the torus is formed, the balls run freely around the track defined by the walls thereof.

Concavedly curved pads 22 are supported upon saddles 23 which are secured to and extend diametrically inwardly from the inner wall portion 24 of the outer surface of the wall and these pads together with the saddles are situated one adjacent each end of the half 11 of the torus. The pads are preferably formed from foam but of course other materials may be utilized.

An adjustable slightly concavedly curved pad 25 is mounted to a plate 26 which, in this embodiment, has a pair of rods 27 extending diametrically outwardly from the back of the plate 26. These rods slideably engage within split sleeves 28 which extend diametrically inwardly from the inner wall portion 24A of the outer surface of the other half 10 as clearly shown in the drawings. The ends of the split sleeves are screw threaded as indicated by reference character 29 and plastic nuts 30 screw threadably engage these ends so that when the pad 25 is adjusted diametrically to the desired extent, it is locked in position by tightening the nuts 30 upon the screw threaded ends 29 of the split sleeve 28.

In operation, the required number of balls 21 is placed within the track 20 whereupon the torus is engaged around the wrist of the user with the inside of the wrist resting upon the foam pads 22 when the torus has been closed around the wrist and clamped into position by means of the clasp assembly 17. The adjustable pad 25 is positioned so that it rests upon the top of the wrist as shown in FIG. 7 so that when the fist is clenched, there is no pressure on the wrist artery and veins yet at the same time it is prevented from disengaging from the wrist by the clasp 17 and the clenching of the fist as shown in FIG. 7.

In this position, simple circular movements of the wrists start the balls rotating and by using different ball weights and/or numbers, one can increase or decrease the workload.

The device is easily transported in luggage and can be used in any convenient location.

Advantages include the using of the momentum from a rapidly moving weight as its active force together with using this centrifugal force to create a constantly changing strain on the muscle groups of the arms, shoulders, chest and to a lesser degree the waist and abdomen.

It combines muscle building with aerobic exercise and has considerable versatilities such as the positioning of the arms/wrists to achieve more workload on different muscles, varying degree of weights to accommodate beginner, intermediate, and advanced users and of course it is relatively small in size and economical in manufacture.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A wrist engaging exercising device comprising in combination an annular hollow member, means for detachably engaging said hollow member around the wrist of the user having wrist engaging means projecting centrally from the annular hollow member and including adjustment means for adjusting the wrist engaging means to fit, within limits, wrists of various thicknesses, and at least one weight confined within said hollow member but freely movable therearound.

2. The device according to claim 1 in which said hollow member is substantially circular in the form of a torus.

3. The device according to claim 2 in which said hollow member comprises a wall with inner and outer surfaces and said torus is formed in two open-ended halves pivotally connected together by adjacent one ends thereof by hinge means on the outer surface of the wall and detachably securable together by the other pair of adjacent ends and means for detachably securing the other adjacent ends together.

4. The device according to claim 3 in which said means for adjusting the wrist engaging means includes a pair of spaced apart concavedly curved padded members situated on the innermost portion of the outer surface of one of said halves and extending diametrically inwardly and a diametrically adjustable pad member on the innermost portion of the outer surface of the other of said halves, said pads being situated substantially 60° radially from one another.

5. The device according to claim 11 in which said adjustable pad member includes at least one rod portion extending diametrically outwardly from the rear surface thereof, an outer screw threaded split sleeve extending diametrically inwardly from said innermost portion of the outer surface of said other half and being slideably engagable by said rod, and clamp nut means screw threadably engaging said split sleeve to clamp same around said rod.

6. The device according to claim 3 in which said means on the outer surface of the wall thereof for detachably securing said other adjacent ends together takes the form of a pivoted clasp loop on the outer surface of one of said other adjacent ends and clip means on the outer surface of the other of said adjacent ends, said loop selectively and detachably engaging said clip means for detachably securing said halves together to form said torus.

7. The device according to claim 6 in which said means for adjusting the wrist engaging means includes a pair of spaced apart concavedly curved padded members situated on the innermost portion of the outer surface of one of said halves and extending diametrically inwardly and a diametrically adjustable pad member on the innermost portion of the outer surface of the other of said halves, said pads being situated substantially 60° radially from one another.

8. The device according to claim 17 in which said adjustable pad member includes at least one rod portion extending diametrically outwardly from the rear surface thereof, an outer screw threaded split sleeve extending diametrically inwardly from said innermost portion of the outer surface of said other half and being slideably engagable by said rod, and clamp nut means screw threadably engaging said split sleeve to clamp same around said rod.

9. The device according to claim 2 in which said hollow member comprises a wall with inner and outer surfaces, the inner surface defining a track, said weight taking the form of a ball rollable around said track.

10. The device according to claim 9 in which said torus is formed in two open-ended halves pivotally connected together by adjacent one ends thereof by hinge means on the outer surface of the wall and detachably securable together by the other pair of adjacent ends and means for detachably securing the other adjacent ends together.

11. The device according to claim 10 in which said means on the outer surface of the wall thereof for detachably securing said other adjacent ends together takes the form of a pivoted clasp loop on the outer surface of one of said other adjacent ends and clip means on the outer surface of the other of said adjacent ends, said loop selectively and detachably engaging said clip means for detachably securing said halves together to form said torus.

12. The device according to claim 10 in which said means for adjusting the wrist engaging means includes a pair of spaced apart concavedly curved padded members situated on the innermost portion of the outer surface of one of said halves and extending diametrically inwardly and a diametrically adjustable pad member on the innermost portion of the outer surface of the other of said halves, said pads being situated substantially 60° radially from one another.

13. The device according to claim 15 in which said adjustable pad member includes at least one rod portion extending diametrically outwardly from the rear surface thereof, an outer screw threaded split sleeve extending diametrically inwardly from said innermost portion of the outer surface of said other half and being slideably engagable by said rod, and clamp nut means screw threadably engaging said split sleeve to clamp same around said rod.

14. The device according to claim 1 in which said hollow member comprises a wall with inner and outer surfaces, the inner surface defining a track, said weight taking the form of a ball rollable around said track.

15. The device according to claim 14 in which said torus is formed in two open-ended halves pivotally connected together by adjacent one ends thereof by hinge means on the outer surface of the wall and detachably securable together by the other pair of adjacent ends and means for detachably securing the other adjacent ends together.

16. The device according to claim 15 in which said means on the outer surface of the wall thereof for detachably securing said other adjacent ends together takes the form of a pivoted clasp loop on the outer surface of one of said other adjacent ends and clip means on the outer surface of the other of said adjacent ends, said loop selectively and detachably engaging said clip means for detachably securing said halves together to form said torus.

17. The device according to claim 15 in which said means for adjusting the wrist engaging means includes a pair of spaced apart concavedly curved padded members situated on the innermost portion of the outer surface of one of said halves and extending diametrically inwardly and a diametrically adjustable pad member on the innermost portion of the outer surface of one of said halves and extending diametrically inwardly and a diametrically adjustable pad member on the innermost portion of the outer surface of the other of said halves, said pads being situated substantially 60° radially from one another.

18. The device according to claim 13 in which said adjustable pad member includes at least one rod portion extending diametrically outwardly from the rear surface thereof, an outer screw threaded split sleeve extending diametrically inwardly from said innermost portion of the outer surface of said other half and being slideably engagable by said rod, and clamp nut means screw threadably engaging said split sleeve to clamp same around said rod.

19. The device according to claim 16 in which said means for adjusting the wrist engaging means includes a pair of spaced apart concavedly curved padded members situated on the innermost portion of the outer surface of one of said halves and extending diametrically inwardly and a diametrically adjustable pad member on the innermost portion of the outer surface of the other of said halves, said pads being situated substantially 60° radially from one another.

20. The device according to claim 19 in which said adjustable pad member includes at least one rod portion extending diametrically outwardly from the rear surface thereof, an outer screw threaded split sleeve extending diametrically inwardly from said innermost portion of the outer surface of said other half and being slideably engagable by said rod, and clamp nut means screw threadably engaging said split sleeve to clamp same around said rod.

* * * * *